United States Patent [19]

Reinehr et al.

[11] Patent Number: 4,714,045

[45] Date of Patent: Dec. 22, 1987

[54] DEVICE FOR WETTING THREADS, FILMS OR THREAD BUNDLES WITH LIQUIDS

[75] Inventors: Ulrich Reinehr; Rolf-Burkhard Hirsch; Joachim Dross; Hermann-Josef Jungverdorben, all of Dormagen, Fed. Rep. of Germany

[73] Assignee: Bayer Aktiengesellschaft, Leverkusen, Fed. Rep. of Germany

[21] Appl. No.: 851,064

[22] Filed: Apr. 11, 1986

[30] Foreign Application Priority Data

Apr. 26, 1985 [DE] Fed. Rep. of Germany ..... 3515091

[51] Int. Cl.[4] ..... B05C 3/12

[52] U.S. Cl. ..... 118/420; 425/71; 425/103; 118/325

[58] Field of Search ..... 425/66, 71, 90, 97, 425/91, 94, 103; 118/420, 325; 239/521, 288, 288.3, 518, 499

[56] References Cited

U.S. PATENT DOCUMENTS

| | | | |
|---|---|---|---|
| 1,955,793 | 4/1934 | Dreyfus | 425/66 |
| 3,555,139 | 1/1971 | Waters | 264/210.3 |
| 4,303,607 | 12/1981 | De Maria | 264/210.3 |
| 4,486,377 | 12/1984 | Lucehesi et al. | 264/210.3 |

*Primary Examiner*—Bernard Nozick

*Attorney, Agent, or Firm*—Sprung Horn Kramer & Woods

[57] ABSTRACT

Threads, films or thread bundles which are transported from top to bottom, can be wetted with liquids by means of a device consisting of a system releasing the liquid, conduits and a storage container as well as suitable transporting means for the liquid, whereby the system releasing the liquid has at least two slotted nozzles positioned one above the other and opposite each other, having a horizontal slot and whereby rods are attached at the slot ends which, seen from above, form an angle with the slot of from 100° to 170°, preferably from 115° to 160°.

5 Claims, 2 Drawing Figures

DEVICE FOR WETTING THREADS, FILMS OR THREAD BUNDLES WITH LIQUIDS

BACKGROUND OF THE INVENTION

This invention relates to a device for wetting threads, films or thread bundles which are transported from top to bottom, with liquids, whereby the device consists of a system releasing the liquid, conduits and a storage container as well as suitable transporting means for the liquid, and the use of this device, particularly for applying a preparation of liquid to a thread bundle which has been obtained from a spinning solution according to the dry spinning process.

Various preparation systems have become known in the production of man-made fibres. Thus, for example, the preparation is applied to the fibres by rollers or by metering pumps. A good thread composition and the expanding and loop formation of the cable should be achieved hereby, for example during the plaiting process in spinning cans is prevented. JP No. 74/1006 for example, describes a system of rollers for oiling yarns. Preparation thread guide for applying a preparation liquid on multifilament threads is described by German Utility Model No. 76/5571, whereby the guideway of the threads in the region of the opening to the liquid conduit has a recess. German Utility Model No. 74/42133 describes a further variant, whereby the guideway is bent in a convex manner and the supply nozzle for the preparation liquid opens above the contact zone of the yarn. DE-OS No. 26 09 885 describes a coating head with a gap for releasing the preparation agent and DE-OS No. 20 45 142 proposes a device for treating threads with liquid, whereby the quantity of liquid to be used can be adjusted precisely and constantly by means of a hydrostatic pressure control. DE-OS No. 25 30 618 finally presents a device for the rapid spinning of threads from melts, whereby the threads are wound into a spool package by means of a drive roller, a transverse guide moving along the longitudinal axis of the spool and a support guide through which the threads reach the transverse guide. Wetting between the transverse guide and the support guide can hereby optionally take place.

The above named preparation systems have unsatisfactory results when thread bundles which have been obtained from a spinning solution according to the dry spinning process are to be prepared and then directly supplied for drawing. A process for the continuous production of crimped threads and fibres from acrylonitrile polymers according to the dry spinning method is described in DE-OS No. 32 25 266. The object of the present invention was to provide an improved preparation system for this process. It was thereby important to carry out application of the preparation liquid with low water content in the course of the production process before drawing, such that the spinning cable can be directly supplied to the stretching means without a notable heat loss, and that, in spite of a large number of filaments per spinning shaft, an even preparation application is achieved and the preparation device is simple to maintain.

SUMMARY OF THE INVENTION

These objects are surprisingly achieved according to the invention with a device for wetting threads, films or thread bundles, which are transported from top to bottom, the substrates being wetted with liquids, whereby the device consists of a system releasing the liquid, conduits and a storage container as well as suitable transporting means for the liquid. The system releasing the liquid has at least two slotted nozzles positioned one above the other and opposite each other having a horizontal slot, whereby rods are attached at the slot ends, which, seen from above, form an angle with the slot of from 100° to 170°, preferably from 115° to 160°. In particular, the rods attached at the slot ends are arranged horizontally. The slots of the slotted nozzles are spaced along a horizontal from each other by about the thickness of the thread, the film or the thread bundle. It is preferable if two respective slotted nozzles are positioned one above the other at a height of from 5 to 50 mm.

The device according to the invention serves for wetting threads, films or thread bundles with liquids, particularly for wetting thread bundles with a preparation liquid. The device according to the invention preferably serves to apply a preparation liquid on a thread bundle which has been obtained from a spinning solution according to the dry spinning process, whereby the device is preferably positioned within the spinning shaft, from 20 to 100 mm from the lower spinning shaft end. Most particularly advantageous is the use of the device according to the invention for applying a preparation liquid onto a thread bundle which has been obtained from a spinning solution according to the dry spinning process and is supplied for drawing without interruption.

The application of liquid preparations of softening agents by the device according to the invention is to be explained in more detail below by means of elementary diagrams.

DETAILED DESCRIPTION OF THE INVENTION

Figure 1:
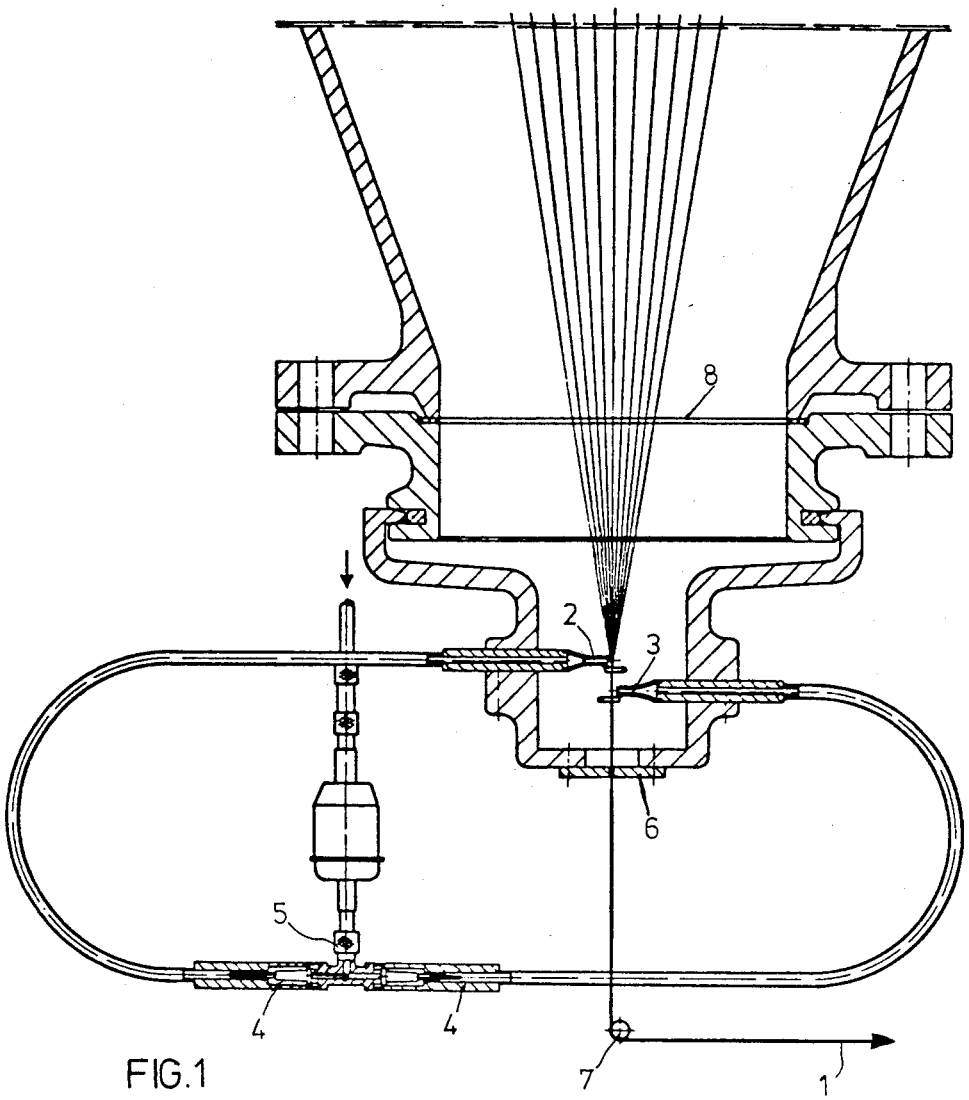
FIG. 1 is a front view of a lower spinning shaft end according to the invention.

FIG. 1 shows a front view of the lower spinning shaft end. The thread bundle 1 is bunched in the shaft interior by thread guides (2,3) positioned opposite each other, which are arranged at a height from each other of about 10 mm, and is prepared at the same time from the rectangular-shaped slots. The slots are connected to a pressure-controlled metering device (5) via a capilliary tube system (4). The spacing of the lower thread guide to the spinning shaft end is about 40 mm. After flowing through the spinning shaft end (6), the hot, bunched, prepared threads are diverted over a roller or a pin (7) and, combined into a cable strand with the threads of other spinning shafts, are directly supplied to the stretching device. Evaporated quantities of spinning solvent are drawn off in advance in the spinning shaft via a perforated ring (8).

Figure 2:
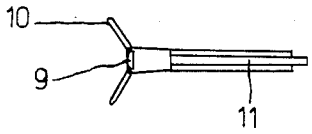
FIG. 2 is a top view of a thread guide with a slotted nozzle.

FIG. 2 shows a top view of one of the thread guides (2,3) with the slotted nozzle (9), on which the side rods (10) are attached. The liquid is brought to the slotted nozzle via the conduit (11).

The preparation system can be used in principle for all threads and multifilament threads. Spinning solution additives such as matting agents, colour pastes or pigments do not influence the preparation and further processing with the device according to the invention. The word "preparations" refers to all liquid or pasty agents which are to be applied on single or multifilament threads, thus softening emulsions, antistatic agents, spool oils or spinning/stretching preparations as are described, for example, in Chemiefasern/Textilindustrie April 1982, page 265. With the preparation process according to the invention, it has been shown to be extremely advantageous to carry out application of the preparation already in the shaft interior to the thread bundle whilst still hot. For this prupose, it is particularly favourable to use warm preparation liquids, preferably having a temperature above 70° C. As a result of the high thread temperatures, which generally lie above 100° C. (measured without contact with the radiation thermometer KT 15 by the firm Heimann GmbH, Wiesbaden), the threads of many spinning shaft positions combined into thick fibre cables can be perfectly hot-drawn without a high energy supply. An extremely good preparation distribution simultaneously takes place on the threads as a result of the high temperatures.

A further possibility consists in applying the preparation system directly below the shaft end of the spinning shafts.

EXAMPLE 1

The 30% by weight spinning solution of an acrylontrile copolymer consisting of 93.6% by weight of acrylonitrile, 5.7% by weight of acrylic acid methyl ester and 0.7% by weight of sodium methallyl sulphonate in dimethyl formamide, which after dissolving has a viscosity of 8.3 Pa.s, measured at 100° C., is cooled to 90° C., filtered and directly supplied to a spinning apparatus with 30 spinning shafts. The spinning solution is dry-spun from 1264-perforated nozzles with a nozzle perforation diameter of 0.2 mm, with a drawing speed of 100 m/min. The shaft temperature is 200° C. and the air temperature is 380° C. The permeated quantity of air is 47 $m^3/h$ for each shaft which is blasted in at the head of the shaft in a longitudinal direction to the threads. The 1264 filaments per spinning shaft which have a total titre of 12850 dtex are bunched in the spinning shaft via two thread guides (FIG. 2) and simultaneously wetted with an 80° to 90° C. warm, aqueous, oil-containing, anti-static preparation such that the oil content of the threads is 0.16% by weight, the content of antistatic agent is 0.04% by weight and the moisture 1.1% by weight, based on the solids content. The metering is pressure-controlled. The pressure in the preparation conduit is 0.3 bar with a capilliary diameter of the preparation tube of 0.42 mm. The metered quantitiy of preparation liquid is 12 ml/min per spinning position. The bunched prepared thread bundle has a surface temperature of 132° C. directly after leaving the spinning shaft and a residual solvent content of 9.5% by weight of dimethyl formamide, based on the solids. The spinning bulk is then diverted and united with the spinning bulk of the other spinning shafts to a fibre cable with a total titre of 385 500 dtex, directly drawn over a hot pair of rollers in the ratio 1:4, crimped and relaxed in saturated steam. The finished cable shrunk to completion is then cut to staple fibres with a length of 60 mm, blown and packed into balls. The fibres which have an individual fibre end titre of 3.3 dtex, a fibre strength of 2.76 cN/dtex and an elongation of 45% can be perfectly carded to a high quality card at a rate of 120 m/min and further processed into yarns.

We claim:

1. In a spinning shaft end device for wetting threads, films or thread bundles which are transported from top through bottom thereof with a liquid including having means for releasing the liquid, conduits and a storage container and transporting means, the improvement wherein the means for releasing the liquid has at least two slotted nozzles positioned one above the other and opposite each other and each having a horizontal slot, and rods attached at slot ends, which, seen from above, form an angle with the slot of from 100° to 170°.

2. A device according to claim 1, wherein the rods attached at the slot ends are arranged horizontally.

3. A device according to claim 1, wherein the slots of the slotted nozzles are horizontally apart from each other by about the thickness of the thread, the film or the thread bundle.

4. A device according to claim 1, wherein the two respective slotted nozzles are positioned one above the other at a height of from 5 to 50 mm.

5. A device according to claim 1, wherein the angle is from 115° to 160°.

* * * * *

UNITED STATES PATENT AND TRADEMARK OFFICE

CERTIFICATE OF CORRECTION

PATENT NO. :4,714,045

DATED :December 22, 1987

INVENTOR(S) : Ulrich Reinehr, et al.

It is certified that error appears in the above-identified patent and that said Letters Patent is hereby corrected as shown below:

| | |
|---|---|
| Title Page, under "U.S. Patent Documents | line 1, after "Dreyfus", insert --et al--<br>line 2, after "Waters", insert --et al--<br>line 3, after "De Maria", insert --et al--<br>line 4, correct spelling of --Lucchesi-- |

Signed and Sealed this

Thirtieth Day of August, 1988

*Attest:*

*Attesting Officer*

DONALD J. QUIGG

*Commissioner of Patents and Trademarks*